US007357406B2

(12) United States Patent
Krumbeck et al.

(10) Patent No.: US 7,357,406 B2
(45) Date of Patent: Apr. 15, 2008

(54) SKI BOOT SOLE, DISENGAGEABLE SKI BINDING AND COMBINATION THEREOF

(75) Inventors: Markus Krumbeck, Murnau (DE); Michael Mangold, Grainau (DE); Andreas Mann, Garmisch-Partenkirchen (DE); Antonello Marega, Treviso (IT); Andrea Gabrielli, Predazzo (IT)

(73) Assignees: Marker Deutschlanf GmbH, Penzberg (DE); Tecnica S.p.A., Giavera del Montello (TV) (IT); Völkl Sports GmbH & Co. KG, Straubing (DE)

( * ) Notice: Subject to any disclaimer, the term of this patent is extended or adjusted under 35 U.S.C. 154(b) by 24 days.

(21) Appl. No.: 11/515,996

(22) Filed: Sep. 5, 2006

(65) Prior Publication Data

US 2007/0035108 A1 Feb. 15, 2007

Related U.S. Application Data

(63) Continuation of application No. 10/723,336, filed on Nov. 26, 2003, now Pat. No. 7,100,938.

(30) Foreign Application Priority Data

Nov. 27, 2002 (DE) ..... 102 55 499

(51) Int. Cl.
*A63C 9/00* (2006.01)

(52) U.S. Cl. ..... 280/611; 280/613; 280/617

(58) Field of Classification Search ..... 280/11.3, 280/11.31, 11.33, 611, 613, 617, 618, 626, 280/629; 36/117.1, 117.3, 125
See application file for complete search history.

(56) References Cited

U.S. PATENT DOCUMENTS

| | | | | |
|---|---|---|---|---|
| 3,918,732 | A | 11/1975 | Wulf | 280/618 |
| 4,026,576 | A | 5/1977 | Frechin | 280/613 |
| 4,182,524 | A | 1/1980 | Beyl | |
| 4,191,395 | A | 3/1980 | Salomon | 280/613 |
| 4,893,831 | A | 1/1990 | Pascal et al. | 280/618 |
| 4,997,199 | A * | 3/1991 | Horn | 280/618 |
| 5,762,357 | A | 6/1998 | Ratzek et al. | 280/607 |
| 6,338,497 | B1 | 1/2002 | Chevalier et al. | 280/612 |
| 6,428,032 | B1 | 8/2002 | Humbel | 280/613 |
| 6,467,795 | B1 * | 10/2002 | Hirayama et al. | 280/613 |
| 6,588,125 | B2 * | 7/2003 | Proctor, Sr. | 36/117.1 |
| 6,773,024 | B2 | 8/2004 | Walkhoff | 280/613 |

* cited by examiner

*Primary Examiner*—Christopher P. Ellis
*Assistant Examiner*—Brian Swenson
(74) *Attorney, Agent, or Firm*—D. Peter Hochberg; Sean F. Mellino; Daniel J. Smola

(57) ABSTRACT

A ski boot sole for cooperating with a ski binding to releasably hold the sole in the binding, the sole having front and rear recesses with front and rear fitting plates. The front recess and the front fitting plate are engaged by the front sole holder rotatable about a longitudinal axis for releasably holding the front sole holder against displacement in the forward, sideways and vertical directions. The rear recess and rear fitting plate are engageable by the rear sole holder which is rotatable about a transverse axis. The rear sole holder butts against the portion of the fitting plate extending outside the border of the sole to secure the rear portion of the sole in the rearward, sideways and vertical directions.

17 Claims, 6 Drawing Sheets

SKI BOOT SOLE, DISENGAGEABLE SKI BINDING AND COMBINATION THEREOF

CROSS REFERENCE TO RELATED APPLICATION

This application is a continuation of U.S. patent application Ser. No. 10/723,336 filed Nov. 26, 2003now U.S. Pat. No. 7,100,938 which claims priority from German patent application Serial No. 102 55 499.4 filed Nov. 27, 2002.

BACKGROUND OF THE INVENTION

1. Field of the Invention

The invention relates to a ski boot soles and to the combination of ski boot soles and ski boot bindings.

2. Description of the Prior Art

In the case of virtually all ski bindings which are currently available on the market, a front boot-retaining unit and a rear boot-retaining unit are arranged on the ski, the front boot-retaining unit interacting in a formfitting manner with the toe end, and the rear boot-retaining unit interacting in a formfitting manner with the heel end, of the "standard" sole of a ski boot. To be precise, the front boot-retaining unit prevents the toe end of the sole from moving forward in the longitudinal direction of the ski and from moving in the direction of the vertical and transverse axes of the ski, while the rear boot-retaining unit secures the heel end of the sole against moving rearward in the longitudinal direction of the ski and against moving in the direction of the vertical and transverse axes of the ski.

Such bindings have reached a high standard of development and a high level of reliability. In principle, however, they have the disadvantage that any dirt which accumulates between the soles and boot-retaining units may influence the disengaging behavior.

Consequently, U.S. Pat. No. 4,182,524 has already developed ski bindings in the case of which the ski boot stands on a standing and/or carrying plate of the binding, it being possible for this plate to be rotated about a vertical ski axis counter to an adjustable resistance. With the boot inserted into the binding, the boot sole is fixed on the carrying plate by means of boot-retaining elements on the plate, which interact with mating elements on the sole.

If the skier's boot or foot tries to execute a rotary movement with respect to the vertical axis of the ski when the skier falls, the resistance to rotation which is to be overcome during this rotary movement is determined, in the case of a binding according to U.S. Pat. No. 4,182,524, exclusively by elements of the binding which can be arranged, in principle, such that they are protected against dirt, for example, according to U.S. Pat. No. 4,182,524, within the standing and/or carrying plate.

Nevertheless, the binding according to U.S. Pat. No. 4,182,524 still does not have a satisfactorily reproducible behavior. The resistance to rotation which counteracts rotation of the standing and/or carrying plate about the vertical axis is determined by a spring arrangement which also gives rise to the disengaging resistance of the boot-retaining elements on the plate. The arrangement here is such that, during rotation of the standing and/or carrying plate about the vertical axis, the boot-retaining elements attain an increasing clearance for movement in the direction of their boot-releasing position. Conversely, the standing and/or carrying plate attains a clearance for rotation as soon as the boot-retaining elements are adjusted in the direction of their boot-releasing position by relative movements between the standing and/or carrying plate and boot sole. It is thus possible for dirt which is found between the standing and/or carrying plate and boot sole to influence, on the one hand, the disengaging behavior of the binding and, on the other hand, the restoring behavior of the binding within its so-called region of elasticity, within which disruptive forces acting on the binding result in movements of the binding elements or parts, but not in the binding being disengaged, with the result that, as the disruptive force dissipates again, the binding can be restored into the normal state, in which the boot is fixed in a predetermined desired position.

SUMMARY OF THE INVENTION

It is an object of the invention, then, in the case of a ski binding, to ensure disengaging and elasticity behavior which can be reproduced to particularly good effect.

This object is achieved according to the invention by a disengageable ski binding having a standing and/or carrying plate which is provided as a standing surface for a ski boot and is arranged on a base or bearing part, which is mounted on the ski and/or can be fitted firmly on the ski, such that it can be rotated about a vertical axis of the base part counter to an adjustable resistance of a first latching device, and having disengageable front and rear boot or sole holders which are arranged on the standing and/or carrying plate and which, in a use position, interact in a formfitting manner with mating surfaces or elements on the boot or boot sole and fix these essentially firmly on the standing and/or carrying plate, it being the case that the rear sole holders, in the case of disruptive forces which raise up the boot vertically from the standing and/or carrying plate, can be adjusted into a release position counter to an adjustable resistance of a second latching arrangement, which is separate from the first latching device, and/or the front boot or sole holders are locked within a predeterminable angle-of-rotation region of the standing and/or carrying plate in respect of the vertical axis, at least essentially without affecting the resistance of the first latching device, and are unlocked outside the region of rotation.

The invention is based on the general idea of ruling out any critical relative movement between the boot sole and standing and/or carrying plate within the region of elasticity of the binding. This is achieved, in the first instance, in that rotary movements of the standing and/or carrying plate about the vertical axis which are caused by disruptive forces, on account of the first and second latching devices being separate from one another and of the initially maintained locking of the front boot and/or sole holders, cannot result in any play, in particular clearance for rotation, of the boot sole relative to the standing and/or carrying plate. Within the region of elasticity, the rotary movement of the carrying and/or standing plate does not have any effect on the position of the boot and/or sole holders relative to the standing and/or carrying plate.

It should be emphasized here that the rear sole holders, according to a preferred embodiment of the invention, can be disengaged only in the vertical direction, i.e. by forces which try to raise up the heel region of the boot vertically from the standing and/or carrying plate. Accordingly, there is no possibility of any displacements between the sole and standing and/or carrying plate in the heel region if disruptive forces give rise to a torque between the boot and ski in respect of the vertical axis.

If any disruptive forces try to raise up the boot vertically from the standing and/or carrying plate, with adjustment of the rear boot holder in the direction of the disengagement state, it is not possible for any dirt between the standing and/or carrying plate and boot sole to have a disruptive influence.

According to a quite particularly preferred embodiment of the invention, the standing and/or carrying plate is assigned a torque support by means of which torques which act on the standing and/or carrying plate in respect of a transverse plate axis are converted into torques in respect of the vertical axis, and a moment which assists further rotation of the standing and/or carrying plate about the vertical axis is produced as soon as the standing and/or carrying plate has left a central position or a central position region. This makes it possible to allow for the fact that torsional loading of the shin and of the ankles and knee joints are to be reduced when the leg is subjected to additional stressing by further forces such as those which typically arise when the skier falls in the forward or rearward direction. Because of the abovementioned torque support, the disruptive forces which are responsible for further stressing are thus used in order to reduce the resistance to rotation which counteracts rotation of the standing and/or carrying plate about the vertical axis, with the result that a rotary displacement of the standing and/or carrying plate which unlocks the front boot or sole holders, and thus release of the boot, are achieved relatively easily.

In addition, as far as preferred features of the invention are concerned, the claims and the following explanation of the drawing illustrate these, with reference to which a particularly preferred embodiment and a number of possible modifications are described in more detail. Protection is claimed here not just for combinations of features which are expressly given in the claims or the description, but also for basically any desired sub-combinations of the features illustrated.

Another feature of the present invention is to provide a ski boot sole having spaced structure for cooperating with ski bindings, where the spacing is constant regardless of changes in sizes of the ski boot sole. The portion can also cooperate or interact with similarly fixed ski binding structure with a play-free form fit. The ends of the ski boot sole can have different shapes since they do not interact with the ski binding.

A preferred embodiment of the ski boot sole according to the invention for use with the disengageable ski binding disclosed herein includes a front fitting plate disposed in a front depression rearward of a front recess for receiving the toe holder of a binding, a front sole holder latching apparatus for being engaged by the toe holder when it enters the front recess, a rear recess for receiving a rear sole holder and rear sole holder latching structure fixed with respect to the sole for being engaged by the rear sole holder.

DESCRIPTION OF THE DRAWINGS

The invention may take physical form in certain parts and arrangement of parts, a preferred embodiment of which will be described in detail in the specification and illustrated in the accompanying drawings which forms a part hereof, and are not meant to limit same, and wherein.

DESCRIPTION OF THE PREFERRED EMBODIMENTS

Figure 2:
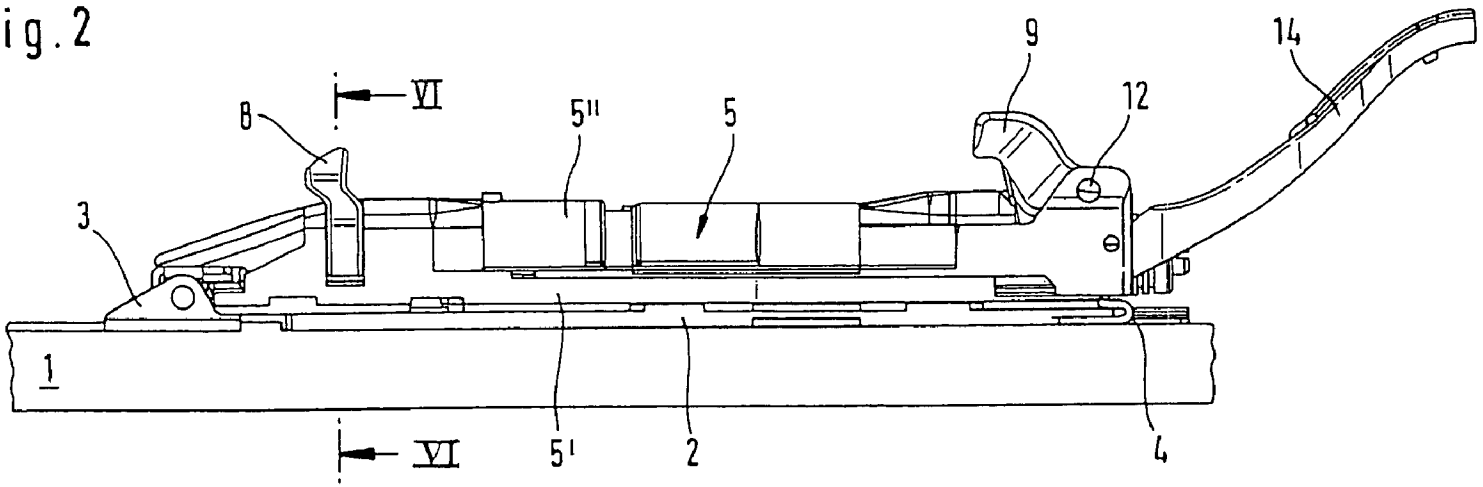
FIG. 2 shows an associated side view.

The binding according to the invention has a base plate 2 which is arranged on a ski 1, indicated partly in FIG. 2, which is connected at its front end, as seen in the longitudinal direction of the ski, in a hinge-like manner to a bearing part 3, arranged firmly on the ski, such that it can be pivoted about a transverse ski axis, and which is secured vertically, with displaceability in the longitudinal direction of the ski, at its rear end, as seen in the longitudinal direction of the ski, in a further ski-mounted bearing part 4.

Arranged on the base plate 2 is a standing and/or carrying plate 5, which can be rotated about a vertical axis of the base plate 2 and of which the top side serves as a standing and/or supporting surface for the sole of a ski boot which is to be inserted into the ski binding. The standing and/or carrying plate 5 has a bottom plate part 5', designed as a frame and structural part, and a covering part 5" on the top side. The abovementioned connection between the base plate 2 and standing and/or carrying plate 5, it being possible for said connection to be pivoted about a vertical axis, is arranged between the base plate 2 and the bottom plate part 5', it being possible for the pivot bearing to be formed, for example, by an elevation in the form of a circular disk being integrally formed on the underside of the bottom plate part 5', said elevation engaging in a correspondingly circular recess in the base plate 2 and being connected firmly to a flange plate 6 (see FIG. 3) which is arranged on the underside of the base plate and overlaps the abovementioned circular recess of the base plate 2 in the radially outward direction.

Figure 1:
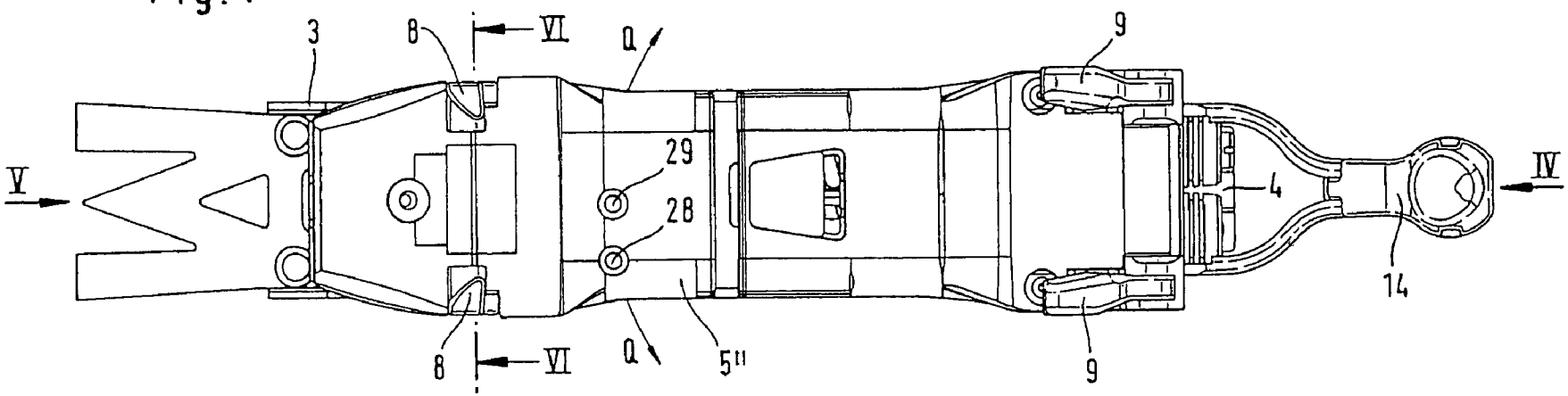
FIG. 1 shows a plan view of the top side of a binding according to the invention.
Figure 3:
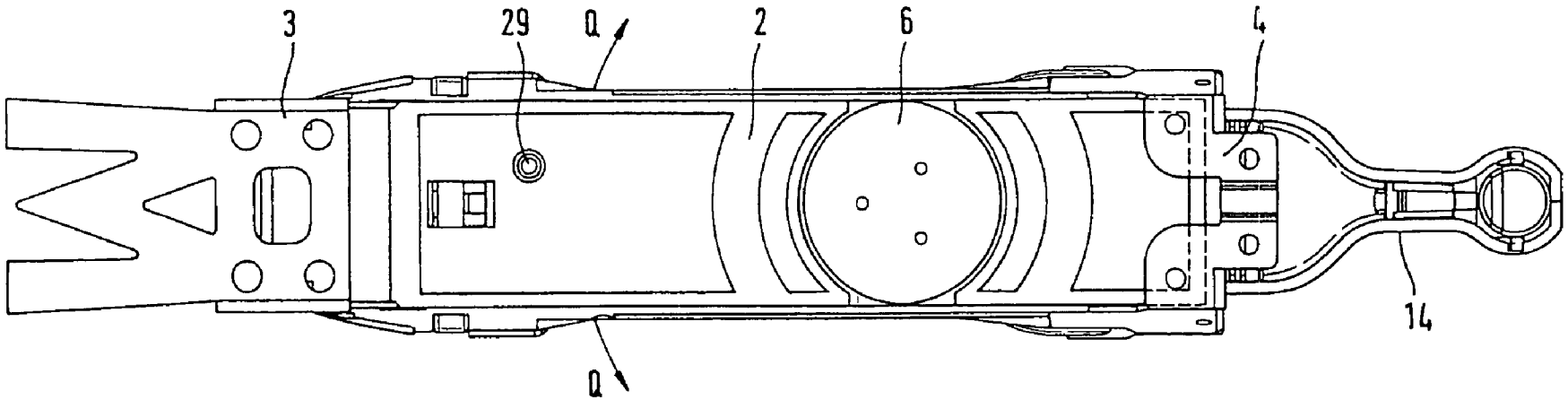
FIG. 3 shows an associated plan view of the underside of the binding.
Figure 5:
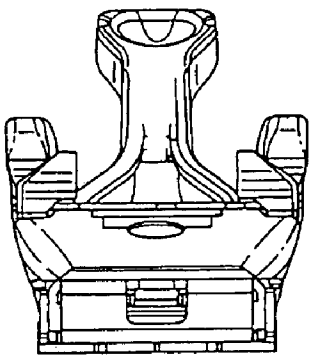
FIG. 5 shows a front view of the binding according to the arrow V in FIG. 1.
Figure 4:
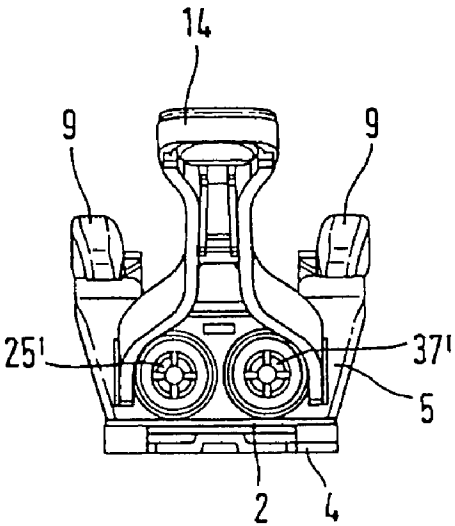
FIG. 4 shows a rear view of the binding according to the arrow IV in FIG. 1.

The standing and/or carrying plate 5 (see FIG. 2) is kept in the central position, which is illustrated in FIGS. 1 and 3, by a first latching device 7, which is explained in more detail below. The carrying plate 5 can be rotated relative to the longitudinal axis of the ski and/or of the base plate 2, counter to the resistance of the abovementioned latching device 7, corresponding to the arrows Q in FIGS. 1 and 3.

Figure 10:
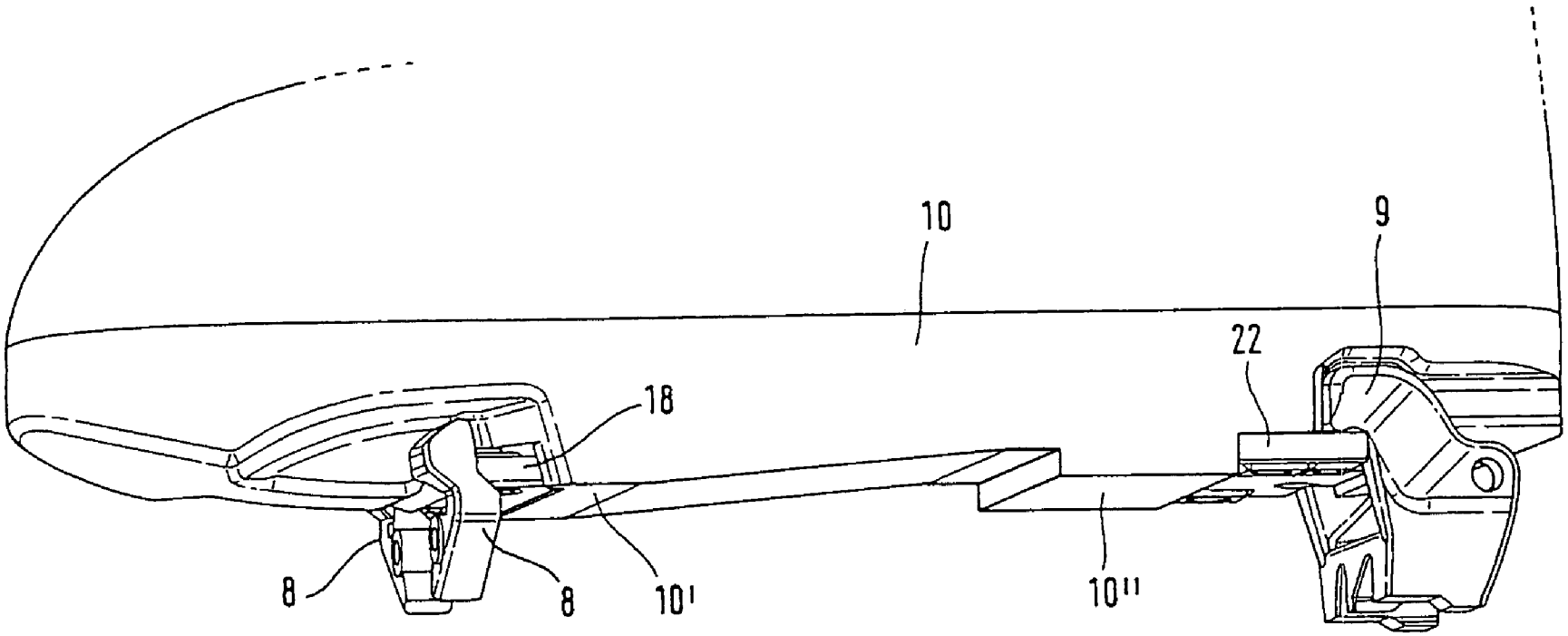
FIG. 10 shows a perspective illustration of the underside of the sole and of the front and rear sole holders interacting with fitting parts on the sole.

Front and rear sole holders 8 and 9 are arranged on the standing and/or carrying plate 5, and the sole 10 of a boot inserted into the binding is fixed in a virtually immovable manner on the standing and/or carrying plate 5 by means of said sole holders in their use position (see, for example, FIGS. 1, 2 and 10).

In the embodiment of FIGS. 1, 2 and 10, the front sole holders 8 can be pivoted into a release position, to the side of the standing and/or carrying plate 5, about axes 11 (see FIG. 6) extending in the longitudinal direction of the standing and/or carrying plate 5, while the rear sole holders 9 can be tilted into a release position about an axis 12 extending in the transverse plate direction.

As is described in more detail below with the explanation of the first latching device 7, the front sole holders 8 are locked in their use position when the standing and/or carrying plate 5 assumes its normal position according to FIGS. 1 and 3 or a position within a pivoting region which is provided for the region of elasticity of the binding and is located on both sides of the normal position. As soon as this pivoting region is exceeded to the right or left, the front sole holders 8 are unlocked, with the result that they can readily be swung or moved into their release position.

The rear sole holders 9 can interact with a second latching device 13, which is explained in more detail below, and with an actuating lever 14. In the case of corresponding disruptive forces or moments acting on the rear sole holders 9, the rear sole holders 9 are tilted, in the clockwise direction in FIG. 2, in a self-retaining release position. It is also possible for the rear sole holders 9 to be changed over between the use position and release position by the actuating lever 14, or for the rear sole holders to interact with the first latching device 7.

Figure 9:
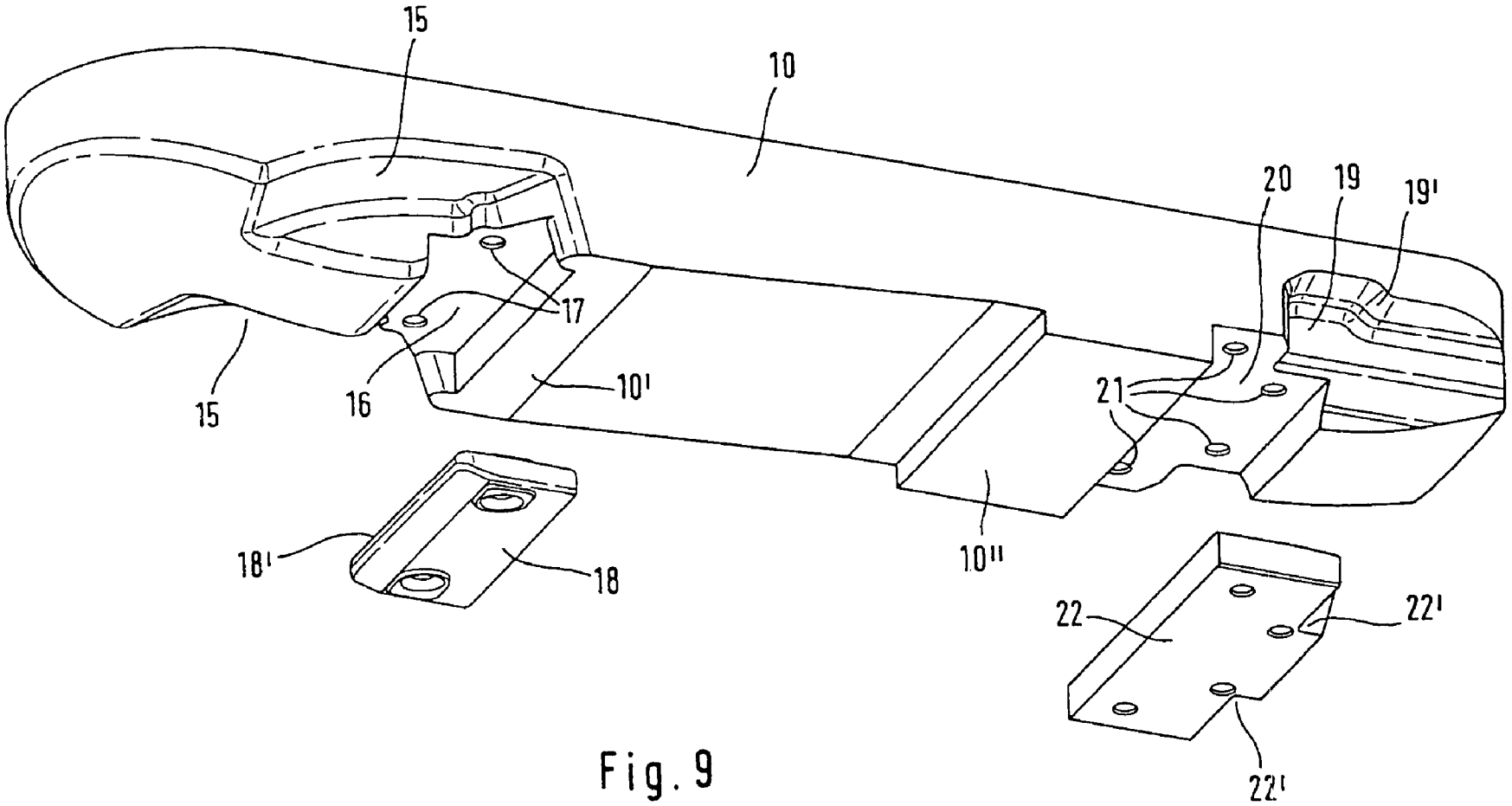
FIG. 9 shows a perspective exploded illustration of the underside of a ski-boot sole interacting with the binding according to the invention.

According to FIGS. 9 and 10, the sole 10 of the ski boot which is to be inserted into the binding has, approximately in the ball-of-the-foot region and/or at a relatively large distance from the toe end of the sole, recesses 15, which are open in relation to the underside of the sole and in relation to the longitudinal borders of the sole, and a depression 16, which is open in the downward direction and in relation to the abovementioned recesses 15 and has a planar base which is provided with accommodating bores 17 for screws or the like. A fitting plate 18 is arranged in the depression 16 and fastened by screws or the like (not illustrated), which are screwed into the accommodating bores 17. The fitting plate 18 has a slightly wedge-shaped front edge 18', of which the corner regions are accommodated in a formfitting manner by corresponding recesses of the front sole holders 8 when the front sole holders 8 assume their use position and the sole 10 is pushed, by way of the front edge 18' of the fitting plate 18, into the abovementioned recesses of the sole holders 8 in the longitudinal direction of the sole, the sole 10 being seated flatly, by way of an underside region 10' adjacent to the fitting plate 18, on the top side of the standing and/or carrying plate 5 in the vicinity of the front sole holders 8.

The abovementioned form fit between the corner regions of the front edge 18' of the fitting plate 18 and the recesses of the front sole holders 8 is designed such that the sole 10 is secured and/or arrested against displacement in the forward, sideways and vertical directions.

The rear region of the sole 10 contains recesses 19 which are open in the downward direction and in relation to the side borders of the sole 10 and merge into a depression 20 which is remote from the rear sole end, is open in the direction of the recesses and in the direction of the underside of the sole and has a planar base with accommodating bores 21 for screws or the like. A fitting plate 22 is arranged in this depression 20 and fixed by screws or the like (not illustrated), which are screwed into the abovementioned accommodating bores 21. The fitting plate 22 is T-shaped in plan view, such that angled indents 22' are formed in the fitting plate 22.

In their use position, the rear sole holders 9, with the boot inserted into the binding, engage over the upwardly-oriented side of the fitting plate 22 from above in the region of the indents 22', in which case those borders of the indents 22' which extend in the longitudinal direction of the sole butt against the mutually facing flanks of the rear sole holders 9 and those borders of the indent 22' which extend in the transverse direction of the sole butt against the front borders of the rear sole holders 9, these borders being essentially vertical in the use position, and an underside region 10" of the sole 10, which extends in front of the fitting plate 22, rests flatly on the top side of the standing and/or carrying plate 5 in the vicinity of the rear sole holders 9. Accordingly, by virtue of a form fit between the fitting plate 22 and the rear sole holders 9, the rear sole region is secured against movement in the rearward, sideways and vertical directions.

The sole 10 need be of rigid design essentially only between the fitting plates 18 and 22, such that the fitting plates 18 and 22 are always in a reproducible position in relation to the regions 10' and 10" on the underside of the sole 10 and, accordingly, can interact with the sole holders 8 and 9 with a play-free form fit. The sole regions in front of and behind the fitting plates 18 and 22 may be formed, for the most part, as desired. In particular, it is possible for the underside of the sole to be curved in these regions so as to facilitate a rolling movement of the foot during walking.

Figure 7:
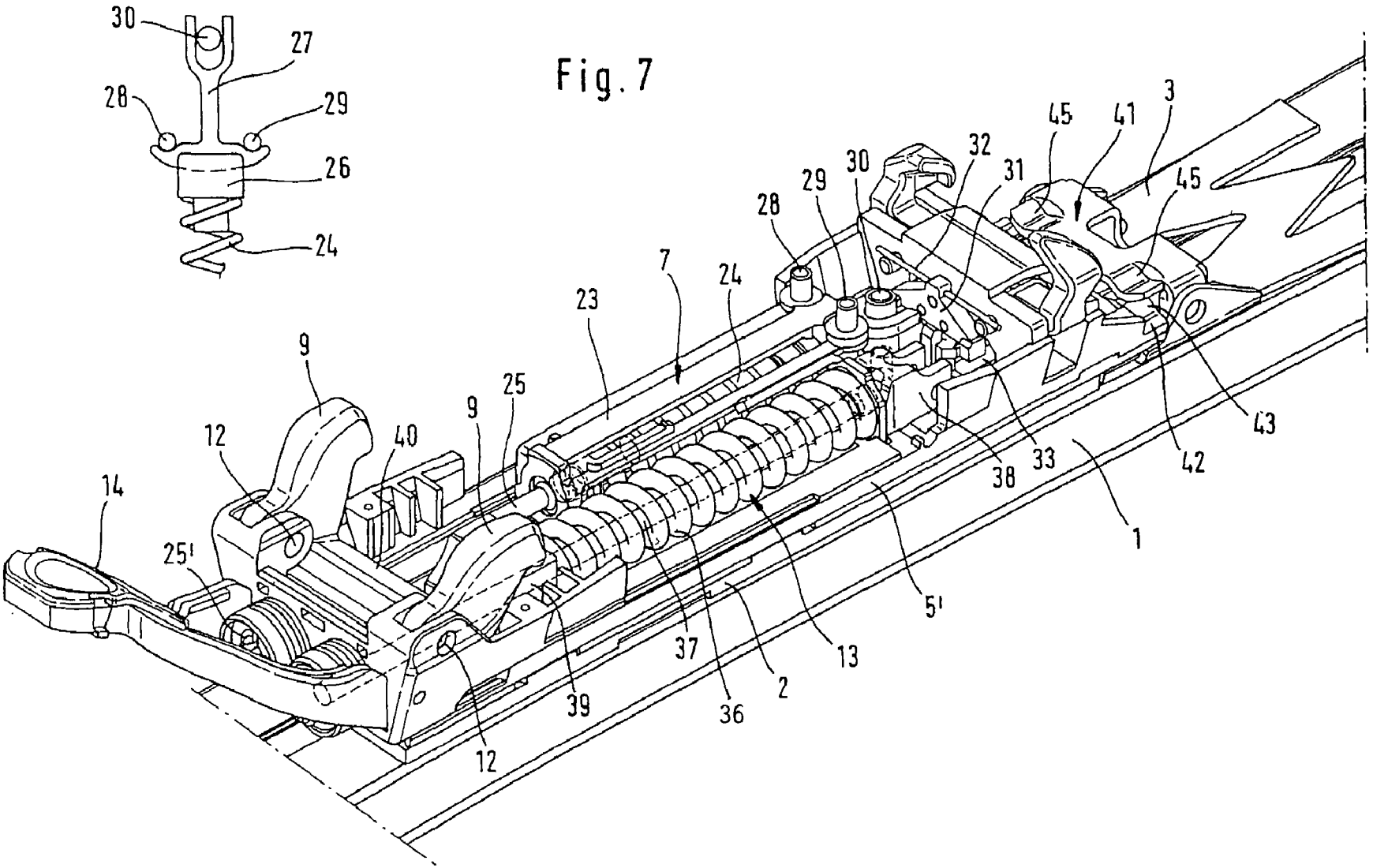
FIG. 7 shows a perspective plan view of the binding according to the invention with the standing and/or carrying plate open on the top side.

The first latching device 7, according to FIG. 7, has a spring housing 23, which is arranged firmly on the bottom plate part 5' of the standing and/or carrying plate 5 and accommodates a helical compression spring 24. One end of the helical compression spring 24 is supported on a spring abutment, which can be adjusted in the longitudinal direction of the spring housing 23 by means of an adjusting screw 25, with the result that it is possible to change the spring stressing by means of a screwing tool which can be attached to the head 25' of the adjusting screw 25, said head being accessible at the rear border of the standing and/or carrying plate 5. The other end of the helical compression spring 24, according to the separate detail form illustration in FIG. 7, is held under stressing against a piston 26, which can be displaced in the spring housing 23 and, for its part, is held under stressing, by the spring force, against a facing transverse member of a tilting lever 27, said transverse member of the tilting lever 27 engaging in a transverse slot on the facing side of the piston 26. The transverse member of the tilting lever 27 interacts with tilting pins 28 and 29, which are firmly arranged as parts of the spring housing 23 and around which the transverse member of the tilting lever 27, in the normal position thereof, engages by way of corresponding, approximately semicircular recesses. The helical compression spring 24 and the piston 26 on which the latter acts try to keep the transverse member of the tilting lever 27 in abutment against the two tilting pins 28 and 29. If the tilting lever 27 is pivoted about one of the tilting pins 28 or 29 by corresponding forces, the piston 26 is forced back counter to the force of the helical compression spring 24 as soon as the tilting lever 27 is subjected to a moment which overcomes the prestressing of the helical compression spring 24.

The tilting lever 27 engages, by way of a fork-like end, around a pin 30 which is firmly arranged on the base plate 2. Correspondingly, the tilting lever 27 has to be deflected out of its normal position, which is illustrated in FIG. 7, with pivoting about the tilting pin 28 or 29, when the standing and/or carrying plate 5 on the base plate 2 executes a rotary movement about the vertical axis passing centrally through the flange plate 6 (see FIG. 3).

As a result, it is thus only possible for the standing and/or carrying plate 5 to execute a rotation about the abovementioned vertical axis on the base plate 2 when the standing and/or carrying plate 5 is subjected to a sufficient torque, the magnitude of which is determined by the prestressing of the helical compression spring 24. As soon as this torque is exceeded, the standing and/or carrying plate 5 is pivoted to a more or less great extent.

On a part which is connected firmly to the bottom plate part 5' of the standing and/or carrying plate 5, a yoke 31 is arranged such that it can be pivoted about a longitudinal plate axis. A leg spring 32 forces the yoke 31 into the normal position, which is illustrated in FIG. 7. The ends of the yoke 31 interact, in the manner of cams, with a guide track or guide curve 33 firmly arranged on the base plate 2, such that the yoke 31 executes a pivoting movement in one direction or the other when the standing and/or carrying plate 5 is pivoted relative to the base plate 2 in one direction or the other.

Figure 6:
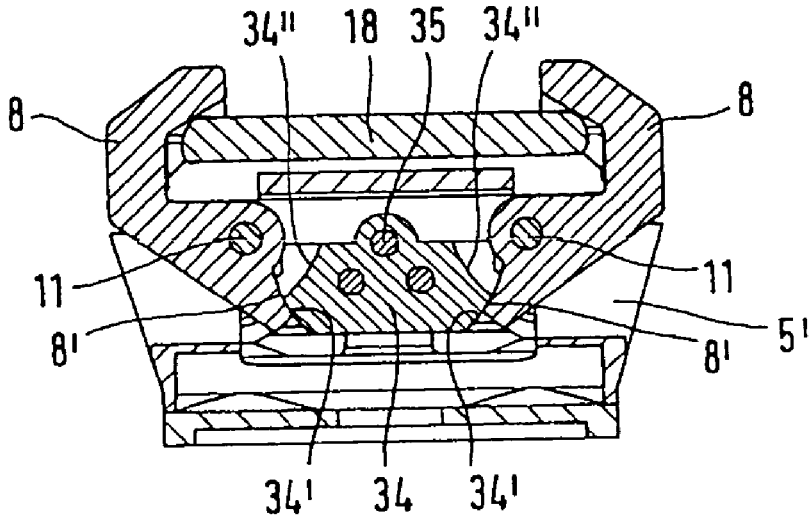
FIG. 6 shows a sectional view corresponding to section line VI-VI in FIGS. 1 and 2.

The yoke 31 is coupled in a rotationally fixed manner to a control plate 34, which can be seen in FIG. 6 and has circle-arc-shaped border sections 34' located centrally in relation to the pivot pin 35, and adjoining border sections 34" which are located more or less radially in relation to the pivot pin 35.

In the normal position of the yoke 31 and of the control plate 34, the border sections 34' butt against associated borders 8' of the front sole holders 8, which are in the form of double levers according to FIG. 6, with the result that these are locked in their use position. When the standing and/or carrying plate 5 is pivoted sufficiently widely relative to the base plate, the control plate 34 executes a pivoting displacement of such a magnitude that one of the front sole holders 8 is freed from the associated border section 34' of the control plate 34 and, by way of its control-plate end, can slide onto the adjacent border section 34" and, accordingly, execute a pivoting movement into its release position. The kinematics between the yoke 31 and guide track or guide curve 33 here are such that, in the case of a corresponding pivoting displacement of the standing and/or carrying plate 5, that sole holder 8 which is arranged on that border side of the standing and/or carrying plate 5 which is oriented in the respective pivoting direction tilts, or can tilt, into its release position.

The second latching device 13, which controls the rear sole holders 9, has a helical compression spring 36, which is clamped in between an abutment 38, which can be displaced on the bottom part 5' of the standing and/or carrying plate 5 by means of an adjusting screw 37, and a piston 39, which can be displaced on the bottom plate part 5'. The threaded part of the adjusting screw 37 is connected in a non-rotatable and axially fixed manner to the abutment 38 and bears an adjusting nut 37' which is accessible from the outside and is mounted in an axially rotatable manner on the rear side of the standing and/or carrying plate 5, with the result that, by screwing adjustment of the adjusting nut 37' on the adjusting screw 37, it is possible to adjust the distance between the abutment 38 and the adjusting nut 37' and thus the prestressing of the helical compression spring 36.

On its end side which is directed toward the rear sole holders 9, the piston 39 has a track-like guide surface which interacts with a cam part, which cannot be seen in FIG. 7, and is arranged on a connecting component 40 which connects the rear sole holders 9 to one another in a rotationally fixed manner and may be integrally formed with the sole holders 9. The cam part and the curved surface here interact such that the piston 39, in the first instance, has to execute a comparatively large displacement counter to the compressive force of the helical spring 36 when the rear sole holders 9 are pivoted rearward by a comparatively small extent out of the use position, which is illustrated in FIG. 7. As the rear sole holders are pivoted further, they pass through a dead-center position between the cam part and track-like curved surface. Thereafter, the cam part of the rear sole holders 9 interacts with part of the curved surface such that the piston 39 is forced rearward by the helical compression spring 36 and the rear sole holders 9 are forced into their release position.

If required, it is also possible for the rear sole holders 9 to be disengaged manually or by means of a ski stick which, for this purpose, is positioned in a depression at the free end of the actuating lever 14 in order to press the lever 14 down toward the top side of the ski.

By virtue of the lever 14 being raised, it is possible for the rear sole holders 9 to be moved, if appropriate, manually into their use position.

It is also possible, when the boot is inserted, for the rear sole holders 9 to be adjusted from their release position into the use position by the boot. Stop steps 19' are formed on the rear recesses 19 of the boot sole 10 and interact with those borders of the rear sole holders 9 which are directed obliquely upward in FIG. 10, with the result that said sole holders are inevitably changed over into their use position when the boot is inserted, by way of the front fitting plate 18, into the front sole holders 8 and then is pushed down, by way of its heel region, against the top side of the standing and/or carrying plate 5. The binding according to the invention is thus designed as a so-called step-in binding.

During skiing, the standing and/or carrying plate 5 is subjected to more or less large torques in respect of a transverse ski axis. When the skier is in a forwardly-inclined position, the front end of the standing and/or carrying plate 5 is forced against the top side of the ski. When the skier, in contrast, is in a rearwardly inclined position, the standing and/or carrying plate 5 is subjected to forces and moments which try to raise up the front end of this plate 5 from the ski 1.

Correspondingly oppositely directed forces arise at the rear end of the standing and/or carrying plate 5.

According to an advantageous embodiment of the invention, then, it is possible to provide a torque support 41 by means of which torques which act on the standing and/or carrying plate 5 in respect of the transverse axis are converted into torques in respect of the vertical axis.

Figure 8:
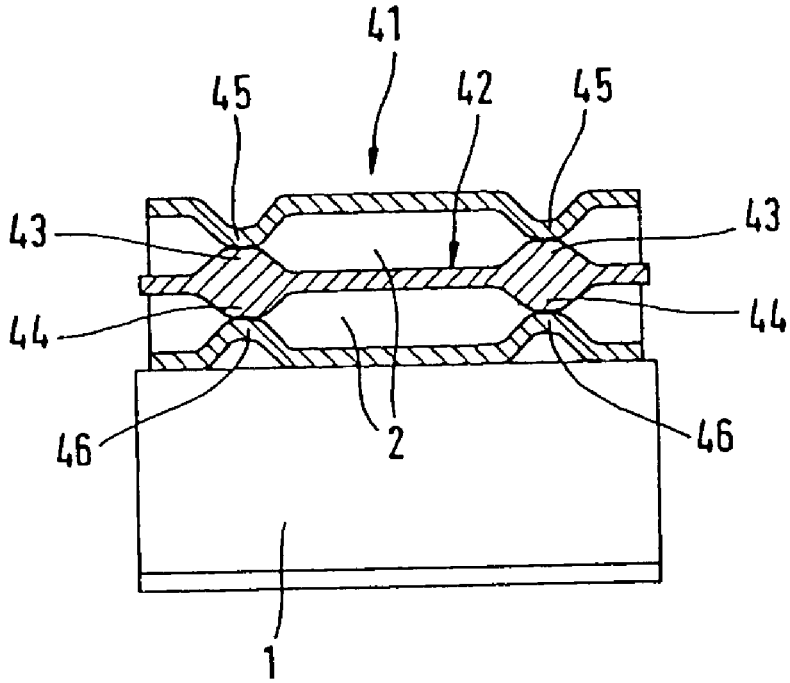
FIG. 8 shows a schematic sectional illustration of a torque support of the standing and/or carrying plate.

As can be gathered from the sectional view of FIG. 8, a profiled strip 42 is firmly arranged on the standing and/or carrying plate 5, this strip extending in the transverse direction of the plate and having, both on its top side and on its underside, in each case two respective elevations 43 and 44, with lateral oblique flanks, and also a horizontal section extending therebetween. Mating elevations 45 and 46 which interact with the elevations 43 and 44 are arranged on the base plate 2.

In FIG. 8, then, the position of the elevations 43 and 44, relative to the mating elevations 45 and 46, are illustrated for the (normal) case where the standing and/or carrying plate 5 assumes its normal, non-pivoted position relative to the base plate 2, i.e. the longitudinal axes of the two plates 2 and 5 coincide with one another in a plan view of the ski 1. In this case, the horizontal sections of the elevations 43 and 44 rest on the corresponding sections of the mating elevations 45 and 46. Irrespective of the magnitude of any possible vertical forces which try to force the front end of the standing and/or carrying plate 5 against the top side of the ski, or try to raise it up from the top side of the ski, and thus result in corresponding pressing forces between the horizontal sections of the mutually opposite elevations 43 to 46, it is not then possible to produce any active torque which tries to rotate the standing and/or carrying plate 5 about its vertical axis. If, however, the standing and/or carrying plate 5 is pivoted some way about the vertical axis counter to the resistance of the first latching device 7, it is possible for the oblique flanks of the mutually opposite elevations 43 to 46 to interact with one another, this resulting in the production of a torque about the abovementioned vertical axis as soon as the front end of the standing and/or carrying plate 5 is forced downward, or raised upward, with the profiled strip 42.

This results in the situation where, when the skier falls in the forward or rearward direction, the standing and/or carrying plate is subjected to an additional torque with respect to the vertical axis as soon as the standing and/or carrying plate 5 has already been deflected out of its central position by a certain extent.

This additional torque counteracts the restoring forces produced by the first latching device 7, with the result that the standing and/or carrying plate 5 can be moved more easily into the rotary position in which a front boot and/or sole holder 8 is unlocked and the boot is disengaged from the binding.

In contrast to the illustration in FIG. 2, it is also possible for the bearing part 4, if appropriate, to be of adjustable design, such that it releases the rear end of the base plate 2 in a release position and the base plate 2, accordingly, can be pivoted up, together with the standing and/or carrying plate 5, about the hinge pin of the bearing part 3. It is thus also possible for the binding according to the invention to be used, if appropriate, as a binding for cross-country skis.

In the case of the embodiment illustrated in the drawing, the front sole holders 8 can be pivoted about axes extending in the longitudinal direction of the standing and/or carrying plate 5. It is also possible, in principle, to provide front sole holders which can be pivoted about vertical and/or oblique axes.

The invention has been described with particular emphasis on the preferred embodiments. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention or the equivalents thereof.

We claim:

1. For use with a ski binding mounted on a ski for releasably securing a ski boot to the ski binding and to the ski, the binding having a front latching apparatus having at least one front sole holder rotatable about a longitudinal axis in the vertically upward locking direction to a front vertical locking position and a rear latching apparatus having at least one rear sole holder rotatable about a transverse axis in the vertically upward locking direction to a rear vertical locking position, a ski boot sole for cooperating with the ski binding for releasably locking the ski boot sole in the ski binding, said ski boot sole having an underside and longitudinal borders, and comprising:

fixing structure fixed with respect to said sole for cooperating with the ski binding for fixing said sole in an operative relationship on the binding;

front recess walls defining at least one front recess open to the underside of said sole and in relation to the longitudinal borders of said sole, said at least one front recess being able to receive the at least one front sole holder during the rotation of the at least one front sole holder in the vertically upward locking direction;

front sole holder latching apparatus fixed with respect to said sole and proximate said at least one front recess for being engaged by the at least one front sole holder when the at least one front sole holder rotates into said at least one recess to the front vertical locking position, to secure said ski boot sole against displacement in the forward, sideways and vertical directions;

rear recess walls defining at least one rear recess open in the downward direction and in relation to the side borders of said sole, said at least one recess being positioned to receive the at least one of the rear sole holders when the at least one rear sole holder rotates into the vertically upward locking direction when said sole is in the operative relationship with the ski binding; and rear sole holder latching structure fixed with respect to said sole for being engaged by the at least one rear sole holder when said at least one rear sole holder rotates into said at least one recess to the rear vertical locking position.

2. A ski boot sole according to claim 1 wherein the front latching apparatus of the ski binding has two front sole holders rotatable about longitudinal axes on opposite sides of the ski binding and the rear latching apparatus of the ski binding has two rear sole holders rotatable about the transverse axis on opposite sides of the ski binding, and wherein said at least one front recess comprises a front recess on opposite sides of said sole for receiving the front sole holders as the front sole holders rotate into the vertical front upward locking position, and wherein said at least one rear recess comprises two rear recesses on opposite sides of said boot sole for receiving the rear sole holders as the rear sole holders rotate into the vertical rear upward locking position.

3. A ski boot sole according to claim 1 wherein the at least one front sole holder has a locating configuration and wherein said front sole holder latching apparatus comprises a front fitting plate having a formfitting configuration for cooperating with the locating configuration of the at least one front sole holder for releasably latching the at least one front sole holder to said front fitting plate.

4. A ski boot sole according to claim 3 where the at least one front sole holder has locating recesses, and wherein said front fitting plate has a slightly wedge-shaped front edge having corner regions for being accommodated in a form-fitting manner by the recesses in the at least one front sole holder when the at least one front sole holder assumes the vertical front upward locking position and said front edge is pushed into the locating recess of the at least one front sole holder.

5. A ski boot sole according to claim 3 and further comprising a front, downwardly-open depression rearwardly adjacent said at least one front recess for receiving said front fitting plate, and front fastening structure for fastening said front fitting plate to said ski boot sole.

6. A ski boot sole according to claim 5 wherein said front depression has a planar base, and wherein said front fitting plate has a planar attachment surface for engaging said planar base of said front depression.

7. A ski boot sole according to claim 6 and further comprising screw-receiving holes in said front fitting plate and screw-receiving holes in said planar base of said front depression for alignment with said screw-receiving holes in said front fitting plate, and wherein said front fastening structure comprises screws for extending through said aligned screw-receiving holes in said front fitting plate and in said planar base of said front depression.

8. A ski boot sole according to claim 3 and wherein the at least one rear sole holder has a locating configuration and wherein said rear sole holder latching structure comprises a rear fitting plate having a form-fitting configuration for cooperating with the locating configuration of the at least one rear sole holder for releasably latching the at least one rear sole holder to said rear fitting plate.

9. A ski boot sole according to claim 8 and further comprising a rear, downwardly-open depression forwardly merging with said at least one rear recess for receiving said rear fitting plate, and rear fastening structure for fastening said rear fining plate to said ski boot sole.

10. A ski boot sole according to claim 9 wherein said rear, downwardly-open depression has a planar base, and wherein said rear fitting plate has a planar attachment surface for engaging said planar base of said rear depression.

11. A ski boot sole according to claim 10 and further comprising screw-receiving holes in said rear fitting plate and screw-receiving holes in said planar base of said rear, downwardly-open depression for alignment with said screw-receiving holes in said rear fining plate, and wherein said rear fastening structure comprises screws for extending through said aligned screw-receiving holes in said rear fitting plate and in said planar base of said rear, downwardly-open depression.

12. A ski boot sole according to claim 8 wherein the at least one rear sole holder has at least one inwardly-facing flank rotating with the rear sole holder about a transverse axis, and wherein said rear fitting plate comprises at least one upwardly-oriented side portion having longitudinally outwardly extending borders and transversely outwardly extending borders from the side of said ski boot sole, said longitudinally outwardly extending borders butting the at least one inwardly facing flank of the at least one rear sole holder and said transversely outwardly extending borders butting against the front borders of the at least one rear sole holder when the at least one rear sold holder is in the rear vertical locking position.

13. A ski boot sole according to claim 8 for use with the at least one front sole holder, wherein said front fitting plate has at least one exposed forwardly-facing corner facing the central longitudinal axis of the ski, the at least one front sole holder having a rearwardly-facing recess for receiving the forwardly-facing corner of said front fitting plate, wherein the at least one front sole holder has a front fitting plate-engaging surface facing the central longitudinal axis of the ski, and wherein said at least one exposed forwardly-facing corner is received by the recess of the at least one front sole holder when the at least one front sole holder is in the front vertical locking position, for securing said ski boot sole against displacement in the forward, sideways and vertical directions.

14. A ski boot sole according to claim 8 for use with the at least one rear sole holder, the at least one rear sole holder having forwardly and downwardly-facing surfaces when the at least one rear sole holder is in the rear verticle locking position, wherein said rear fitting plate comprises upwardly-oriented side borders extending in the longitudinal direction and borders extending in the transverse direction for butting against the respective forwardly and downwardly-facing surfaces when the at least one rear sole holder is in the locking position to secure said rear fitting plate in the rearward, sideways and vertical directions.

15. A ski boot sole according to claim 8 wherein said front fitting plate and said rear fitting plate are separated by a fixed dimension regardless of the size of the ski boot comprising said ski boot sole.

16. For use with a ski binding mounted on a ski for releasably securing a ski boot to the ski binding and to the ski, the binding having a first latching device with at least one vertically movable front sole holder and at least one vertically movable rear sole holder, a ski boot sole for cooperating with the ski binding, said ski boot sole having an underside and longitudinal borders, and comprising:

fixing structure fixed with respect to said sole for cooperating with the ski binding for fixing said sole in an operative relationship on the binding;

front recess walls defining at least one front recess open to the underside of said sole and in relation to the longitudinal borders of said sole, said at least one front recess being positioned to receive the at least one movable front sole holder when said sole is in the operative relationship with the binding;

front sole holder latching structure fixed with respect to said sole and proximate said at least one front recess for being engaged by the at least one front sole holder when said at least one front sole holder is located in said at least one front recess to releasably lock the front of said sole in the ski binding;

rear recess-defining walls defining at least one rear recess open in the downward direction and in relation to the side borders of said sole, said at least one rear recess being positioned to receive the at least one of the rear sole holders when said sole is in the operative relationship with the ski binding; and rear sole holder latching structure fixed with respect to said sole for being engaged by the at least one rear sole holder when said at least one rear sole holder is located in said at least one rear recess to releasably lock the rear of said sole in the ski binding.

17. A ski binding and a ski boot sole wherein said ski binding releasably locks said ski boot sole;

said ski boot binding comprising:

a pair of front sole holders rotatable towards each other about longitudinal axes on opposite sides of said ski binding to a locking position and rotatable away from each other to a release position, said front sole holders each having locating recesses for receiving a corner of an object; and;

a pair of rear sole holders each rotatable about a transverse axis on opposite sides of said ski binding, each of said rear sole holders having a downwardly-facing portion, a mutually-facing flank facing the flank of the other rear sole holder and front borders facing forwardly; and said ski boot sole comprising:

a pair of front recesses on opposite sides of said ski boot sole open to the underside of said sole and in relation to the longitudinal borders of said sole;

a front, downwardly-open depression rearwardly adjacent said front recesses;

a front fitting plate disposed in one of said front, downwardly-open depression and having a formfitting configuration composed of a slightly wedge-shaped front edge having corner regions for being accommodated in a formfitting manner by said recesses in said respective front sole holder when said respective front sole holders assume the locking position and said respective front edge is pushed into said locating recess of said respective front sole holders, for securing said ski boot sole against displacement in the forward, sideways and vertical directions;

a pair of rear recesses on opposite sides of said ski boot sole open to the underside of said sole and in relation to the longitudinal borders of said sole;

a, downwardly-open depression forwardly adjacent to and merging into said respective rear recesses; and a rear fitting plate disposed in said depression, and comprising angled indents with upwardly-oriented sides extending in the longitudinal direction and transversely directed borders;

wherein said rear sole holders rotate into said rear recesses of said sole, said downwardly-facing portion of each of said rear sole holders engage over said upwardly-oriented sides of said rear fitting plate and abut against said mutually-facing flanks of said rear sole holders, and said transversely-directed borders abut against said front borders of said rear sole holders, when said rear sole holders are in the locking position, to secure the rear of said ski boot sole against movement in the rearward, sideways and vertical directions;

the distance between said front and rear fitting plates being constant regardless of the size of said ski boot sole.

* * * * *

UNITED STATES PATENT AND TRADEMARK OFFICE

CERTIFICATE OF CORRECTION

PATENT NO. : 7,357,406 B2
APPLICATION NO. : 11/515996
DATED : April 15, 2008
INVENTOR(S) : Markus Krumbeck et al.

It is certified that error appears in the above-identified patent and that said Letters Patent is hereby corrected as shown below:

Title page, item [73] Assignee: should read as follows: Marker Deutschland GmbH

Signed and Sealed this

Sixteenth Day of March, 2010

David J. Kappos

David J. Kappos
*Director of the United States Patent and Trademark Office*